US005560611A

United States Patent [19]

Kim

[11] Patent Number: 5,560,611

[45] Date of Patent: Oct. 1, 1996

[54] MATHEMATICAL PYRAMID SHAPE BUILDING GAME

[76] Inventor: Yoobong Kim, 1890 14th St., Bettendorf, Iowa 52722

[21] Appl. No.: 373,116

[22] Filed: Jan. 17, 1995

[51] Int. Cl.[6] ..... A63F 3/00

[52] U.S. Cl. ..... 273/272; 273/241; 273/282.1; 273/290; 434/200

[58] Field of Search ..... 273/459, 241, 273/282.1, 290, 272; 434/200, 208

[56] References Cited

U.S. PATENT DOCUMENTS

| | | | |
|---|---|---|---|
| 565,737 | 8/1896 | Gildersleeve et al. | 273/282.1 |
| 947,603 | 1/1910 | Steacy | 273/282.1 |
| 1,421,570 | 7/1922 | Rod | 273/282.1 X |
| 1,499,214 | 6/1924 | Greibel | 273/282.1 X |
| 1,661,711 | 3/1928 | Baughan | 273/282.1 X |
| 2,215,936 | 9/1940 | Robertson | 273/282.1 X |
| 2,463,425 | 3/1949 | Rendel | 273/282.1 |
| 3,267,590 | 8/1966 | Browning | 273/282.1 X |
| 3,744,153 | 7/1973 | Van Es | 35/31 F |
| 3,784,205 | 1/1974 | Cross, Jr. | 273/241 X |
| 3,808,708 | 5/1974 | Huskin | 35/31 D |
| 3,891,217 | 6/1975 | Geary et al. | 273/290 X |
| 3,995,862 | 12/1976 | Bertin | 273/130 AC |
| 4,133,538 | 1/1979 | Ambrose | 273/276 |
| 4,173,833 | 11/1979 | Rosenblatt | 35/22 R |
| 4,219,196 | 8/1980 | DeCanto et al. | 273/126 R |
| 4,565,374 | 1/1986 | Pak | 273/272 |
| 5,314,190 | 5/1994 | Lyons | 273/272 |
| 5,338,203 | 8/1994 | Rheams | 434/208 |

FOREIGN PATENT DOCUMENTS

| | | | |
|---|---|---|---|
| 6401861 | 8/1965 | Netherlands | 273/282.1 |

*Primary Examiner*—Paul E. Shapiro

[57] ABSTRACT

A mathematical game is comprised of a game board with holes arranged in a regular array and playing pieces bearing integer numbers. Players compete to combine the playing pieces and mathematical operations to form a mathematical expression which equals a given answer. Playing pieces used in these mathematical expressions are placed on the game board on the holes. After all holes are filled with playing pieces, playing pieces are stacked on top of the previous layer of pieces by putting the playing pieces into gaps created by the playing pieces of the lower level. More levels of playing pieces are assembled as the game progresses, creating a three-dimensional pyramid shape.

2 Claims, 4 Drawing Sheets

INSTRUCTIONS FOR PLAYING THE GAME

MATHEMATICAL PYRAMID SHAPE BUILDING GAME

FIELD OF THE INVENTION

This invention is for a game board and playing pieces and, in particular, for a method of using a game board and playing pieces for playing a mathematical pyramid shape building game.

DESCRIPTION OF PRIOR ART

A number of mathematical board games for the making of mathematical equations and expressions have been known. These games have educational as well as entertainment value.

Prior art includes mathematical games in which players place flat tiles bearing numbers and mathematical operations on a game board to form a mathematical expression. The games of this type all involve combining playing tiles in a two-dimensional fashion on the game board. Examples of this kind of game include U.S. Pat. No. 3,744,153 (Van Es), U.S. Pat. No. 4,565,374 (Pak), U.S. Pat. No. 5,314,190 (Lyons), and U.S. Pat. No. 5,338,203 (Rheams).

Prior art also includes mathematical games in which players compete to create a mathematical expression that equals a given answer number from a given set of numbers or to find numbers making a given answer using a combination of mathematical operations. An example is U.S. Pat. No. 3,808,708 (Huskin).

There are a few examples of three-dimensional mathematical games among the prior art. Some of the prior art three-dimensional games involve rotating or manipulating a pre-existing three-dimensional game apparatus. Examples of this kind of game include U.S. Pat. No. 4,219,196 (DeCanto) and U.S. Pat. No. 3,995,862 (Bertin).

There are also examples among the prior art which involve games using playing pieces to build three-dimensional structures, such as pyramids or tetrahedra. U.S. Pat. No. 4,144,538 (Ambrose) shows a pyramid building game in which players compete to build a pyramid structure from blocks, with no mathematical aspect involved.

U.S. Pat. No. 4,173,833 (Rosenblatt) shows a psychological game in which spheres are assembled onto a base to form a tetrahedron. These spheres contain surfaces on which answers to psychological questions may be written.

However, none of the above-mentioned games involve building a three-dimensional shape out of playing pieces which are also used to construct mathematical expressions.

The present invention will seek to provide a mathematical game which is an improvement to the above mentioned mathematical games.

OBJECTS AND ADVANTAGES

Accordingly, several objects and advantages of the present invention are:

a) to provide a mathematical game in which a three-dimensional shape is built out of playing pieces as the game is played;

b) to provide a mathematical game in which players compete to use numbered playing pieces and mathematical operations to form a mathematical expression equalling some randomly determined target answer;

c) to provide a mathematical game in which there is not only one fixed solution, but multiple possible solutions;

d) to provide a mathematical game in which players compete against each other simultaneously to be the first to find a solution, instead of taking turns;

e) to provide a mathematical game which encourages development of arithmetic skills and creativity in the players of the game;

A further object and advantage is to provide excitement to the player as the three-dimensional shape is constructed, because the shape is visually pleasing, and because the difficulty of the game increases as the shape is being built.

Still further objects and advantages will become apparent from a consideration of the ensuing description and drawings.

REFERENCE NUMERALS IN DRAWINGS

Figure 1:
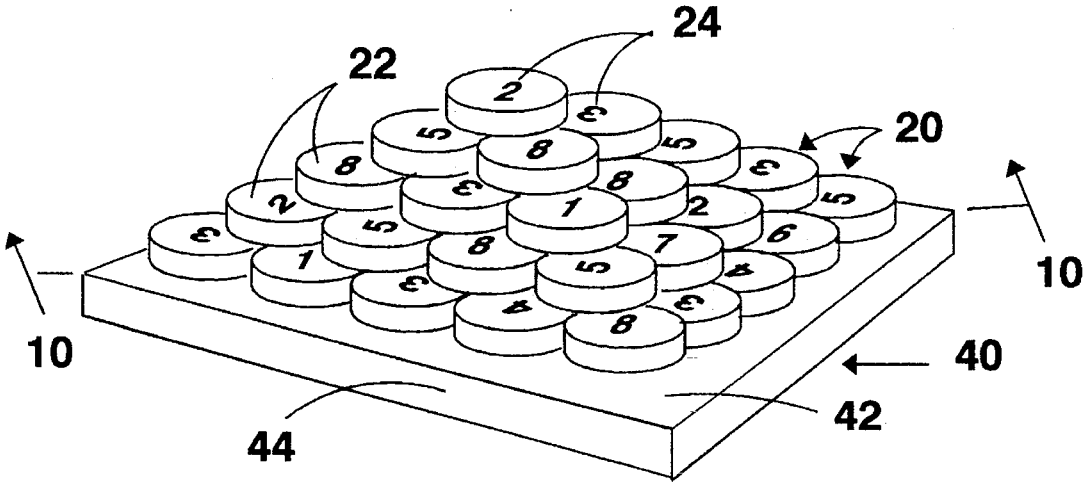
FIG. 1 is a front perspective view of a game with the playing pieces depicted on the game board of the invention.

20 Playing piece
22 Top face of playing piece
24 Integer number
26 Side of upper cylindrical disk of playing piece
28 Tapered peg of playing piece
30 Diameter-sectional view of a playing piece
40 Game board
42 Top surface of game board
44 Side of game board
46 Diagonal-sectional view of the game board
50 Hole
60 die

DESCRIPTION OF PREFERRED EMBODIMENTS

Figure 2:
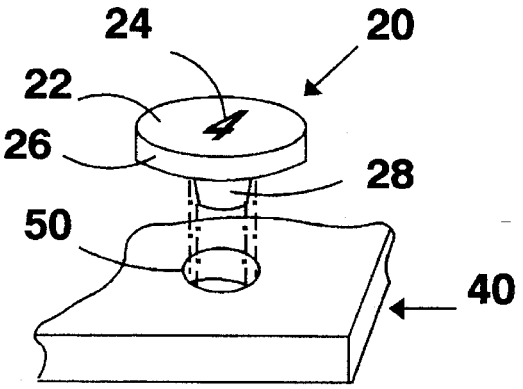
FIG. 2 is an exploded view of a playing piece fitting into a hole on the game board.
Figure 3:
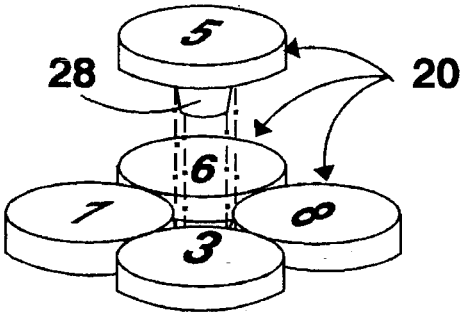
FIG. 3 is an exploded view of a playing piece fitting into a gap created by four playing pieces.

Referring to FIGS. 1–3, FIG. 1 shows the game board 40 and playing pieces 20 illustrated as they may appear after the game is completed. The game board 40 with a flat, square playing surface 42 provides a place on which to stack the playing pieces 20. The playing surface 42 of the game board 40 has holes 50 shown in FIG. 2 that are evenly arranged in a regular square grid pattern. The playing pieces 20 are placed on the holes 50 for the first level of the game. In FIG. 2, the playing pieces 20 have two connected parts: a cylindrical disk 26 and a round tapered peg 28. The tapered peg 28 fits into the holes 50 of the game board 40 and allows players to put the playing pieces 20 easily on the holes 50. FIG. 2 also shows how each playing piece 20 is placed on one of holes 50 on the playing surface 42 of the game board 40. On the top surface 22 of the cylindrical disk 26, an integer number 24 is printed. All playing pieces 20 are identical in shape. Different playing pieces have different integers 24 depicted on their top faces 22. Some playing pieces 20 have the same numbers 24 on their top faces 22. At least two sets of these playing pieces 20 are provided, each set having pieces of a certain color. Each player competes to put more of his/her playing pieces 20 on the game board 40 by finding a mathematical combination of integers 24 on the playing pieces 20 to match a randomly given target number. After all holes 50 are filled with the playing pieces 20 for the first level, the playing pieces 20 for the second level are stacked directly on top of the playing pieces 20 of the first level. Each playing piece 20 of the second level is placed on the gap formed by four playing pieces 20 of the first level. The tapered peg 28 of each playing piece 20 fits into the above mentioned gap and allows players to put the playing pieces 20 easily on the gaps. FIG. 3 shows how each playing piece 20 of the second level is placed on the gap formed by four playing pieces 20 from the first level. For the higher levels, the method of placing the playing pieces 20 on top of the next lower level is the same as the method for the second level. Fewer playing pieces 20 are needed to complete the higher levels of the pyramid than are needed to complete the lower levels. FIG. 1 illustrates that twenty-five (5 by 5), sixteen (4 by 4), nine (3 by 3), four (2 by 2), and one (1 by 1) playing pieces 20 are needed to build levels 1, 2, 3, 4, and 5 respectively. Evenly arranged holes 50 in a regular square grid pattern on the flat surface 42 of the game board 40 and the tapered pegs 28 of bottom part of the playing pieces 20 secure playing pieces 20 from moving and maintain an equal distance among playing pieces 20 in all directions.

Figure 4:
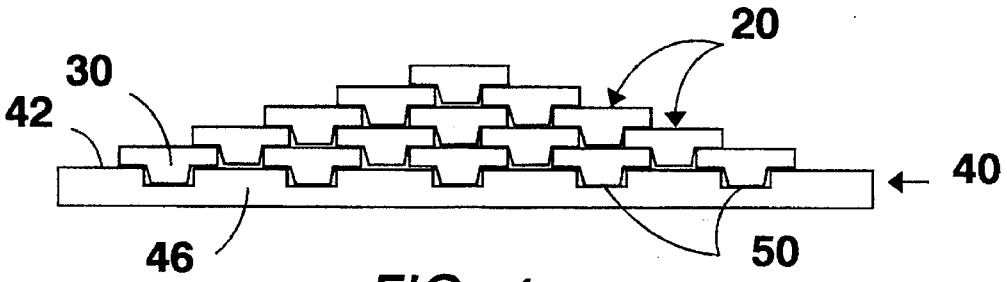
FIG. 4 is a cross-sectional view taken along the line 10—10 in FIG. 1.
Figure 5:
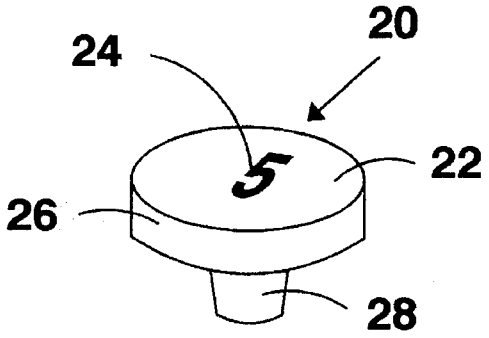
FIG. 5 is a front perspective view of one of the identical playing pieces.
Figure 6:
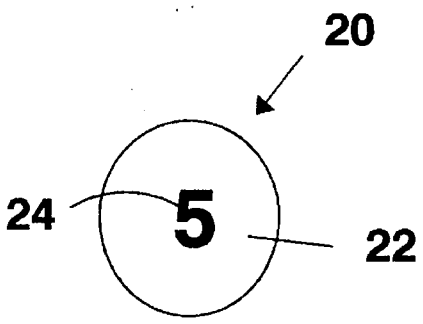
FIG. 6, 7, and 8 are top, side, and bottom plan views respectively of the FIG. 5 piece.
Figure 7:
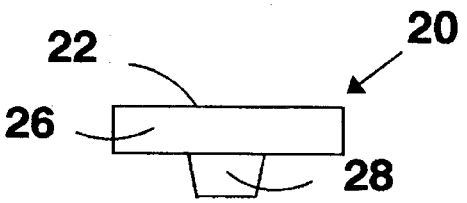
Figure 8:
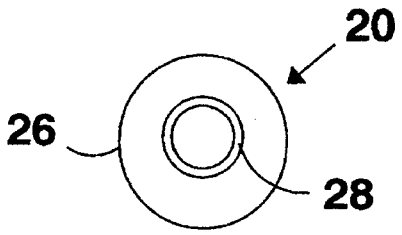

FIG. 4 is a cross-sectional view taken along the line 10—10 of FIG. 1. FIG. 4 shows how playing pieces 20 are stacked in FIG. 1 using cross-sectional views 30 of playing pieces 20 and a diagonal-sectional view 46 of the game board 40. The playing pieces 20 that comprise level 1 of the pyramid are placed on the game board 40. After level 1 is formed, each successive level of the pyramid is built on top of the preceding level.

FIGS. 5–8 show the structure of each playing piece 20. A perspective plan view, top plan view, side plan view, and bottom plan view of a playing piece 20 are shown in FIG. 5, FIG. 6, FIG. 7, and FIG. 8 respectively. A playing piece 20 is comprised of two parts connected to each other: a cylindrical disk 26 and a tapered peg 28. Each playing piece 20 has a top surface 22 on which an integer number 24 is printed. The tapered peg 28 is sufficiently sized to allow players to put playing pieces 20 easily into holes 50 in a game board 40 as illustrated in FIG. 2 and into a gap formed by four playing pieces 20 on the next lower level as illustrated in FIG. 3.

Figure 9:
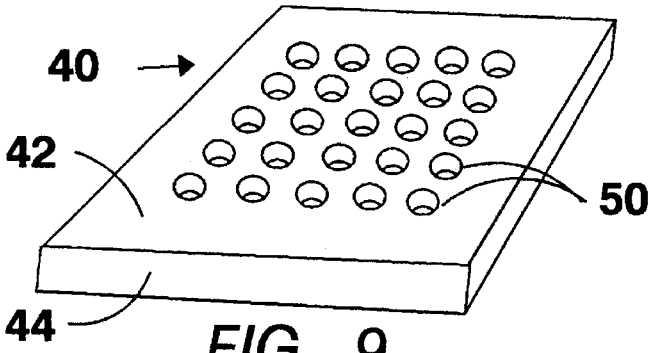
FIG. 9 is a front perspective view of the game board.
Figure 10:
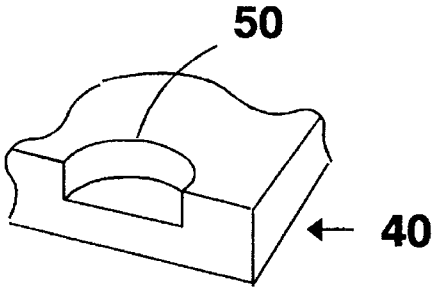
FIG. 10 is an enlarged fragmentary view of the game board with a cut-away of one of the identical holes on the game board.

FIGS. 9 and 10 are related to the game board 40 itself. The game board 40 is a square slab and has four sides 44 of the same thickness. On the surface 42 of the game board 40, identical cylindrical holes 50 are arranged in a square grid pattern. FIG. 9 illustrates a square grid pattern with twenty-five (5 by 5) holes 50. FIG. 10 shows an enlarged cut-away view of a hole 50.

Figure 11:
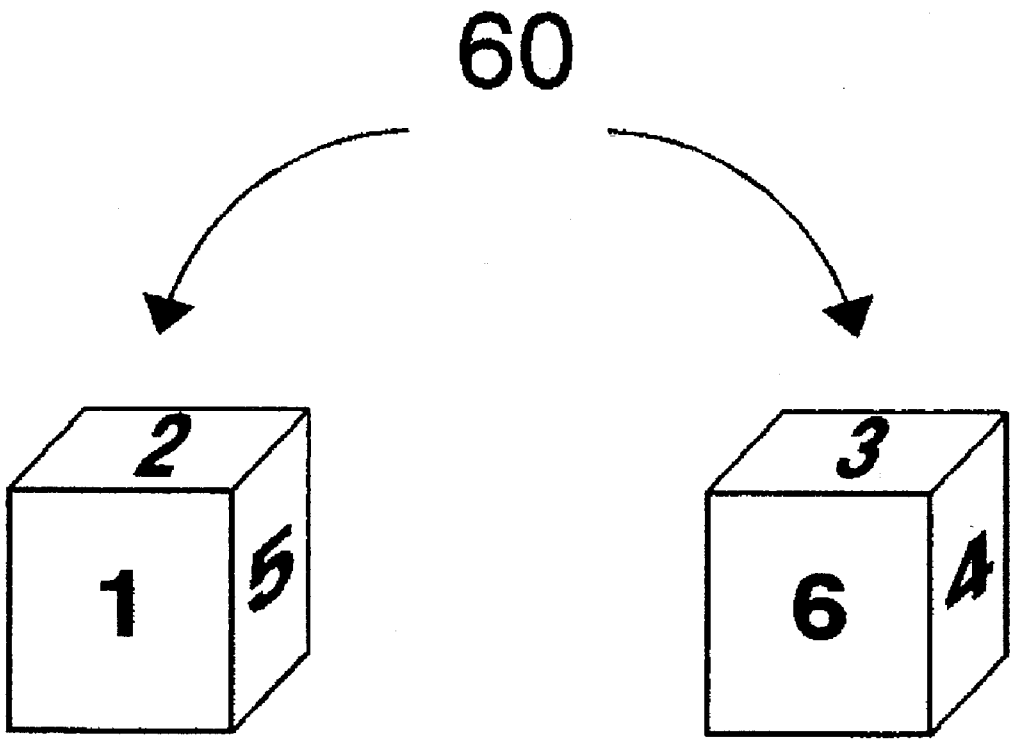
FIG. 11 is a front perspective view of a pair of dice.
Figure 12:
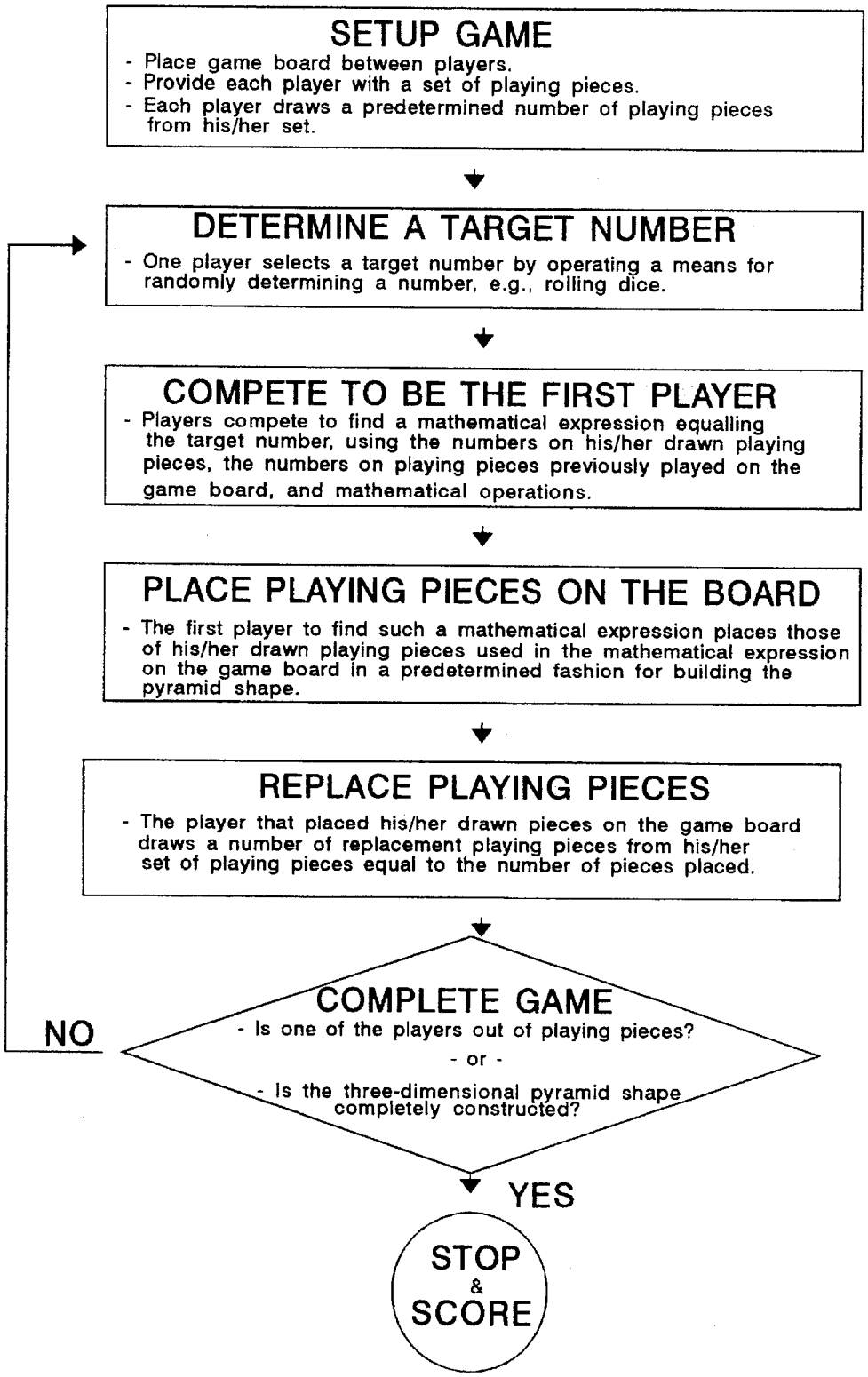
FIG. 12 is a flowchart describing a method for playing the game.

FIG. 11 shows a pair of identical, standard dice 60, which may be used by the players to randomly determine target numbers.

OPERATIONS OF INVENTION

The operation of the invention is shown in the flowchart of FIG. 11. Each of the players draws an equal number, e.g., three, of playing pieces from his/her own draw pile of pieces, which contains all the pieces of one color. Each player then competes to find a mathematical expression (made up of a combination of his/her playing pieces, playing pieces already on the game board, and mathematical operations) that equals a target answer. The target answer is randomly determined by some method of chance, e.g., rolling dice. The player that is first to find an expression equalling the target answer places those playing pieces which comprise the solution on the board. This process is repeated and more pieces are placed on the game board according to certain rules. For example, one such rule could be that the playing pieces must be placed on the game board such that each piece of the solution must be touching at least one other piece of the solution. As the game is played, the pieces on the board form a three-dimensional pyramid shape. The number of playing pieces used to make a solution can depend on what level of the pyramid shape is being built. For example, the higher level of the pyramid shape that is being built, the more pieces a player is required to use in his/her solution. This type of rule would make building the higher levels of the pyramid more challenging and would add climactic excitement as the game progresses. The source of the playing pieces used to make a solution can also depend on what level of the pyramid shape is being built. The source of the playing pieces could be a player's drawn pieces or pieces already on the game board.

Other rules can be specified to simplify the game or make the game more challenging. For example, players can to be used restrict the allowed mathematical operations to be used to only addition and subtraction, if the players are not yet adept with multiplication and division.

The scoring can add interest and emphasize the three-dimensional aspect of the game, with pieces placed on higher levels of the pyramid being awarded more points than pieces placed on lower levels of the pyramid.

SUMMARY, RAMIFICATIONS, AND SCOPE

A mathematical game including a game board and playing pieces is presented. As the mathematical game is played, a three dimensional shape, e.g., pyramid, is constructed from the playing pieces, which are used as operands in mathematical expressions. Players derive excitement and pleasure from the game as the three-dimensional shape is constructed, because the shape is visually pleasing, and because the difficulty of the game may increase as higher levels of the shape are built.

Each player competes to find a mathematical expression (made up of a combination of his/her playing pieces, playing pieces already on the game board, and mathematical operations) that equals a target answer. The target answer is randomly determined by some predetermined means of chance. The player to first find a correct solution places the pieces comprising the solution in some predetermined fashion on the game board. Play continues in this way until a three-dimensional shape is completed. Scoring can be used to add further excitement and challenge to the game.

The game board is provided with a playing surface on which holes are evenly arranged in a regular square grid pattern. Each playing piece has two connected parts: a cylindrical disk and a round tapered peg. The tapered peg portion of each playing piece fits into the holes on the board and allows players to put the playing pieces easily on the holes. On the top surface of the cylindrical disk, an integer number is printed. The playing pieces are placed on the holes of the board for the first level of a game. After all holes are filled with playing pieces, playing pieces for the second level are stacked directly on top of the playing pieces of the first level. Each playing piece of the second level is placed on the gap formed by four playing pieces of the first level. The pieces comprising the higher levels of the pyramid are placed on the next lower level in a similar manner.

Although the description above contains many specificities, these should not be construed as limiting the scope of the invention but as merely providing illustrations of some of the presently preferred embodiments of this invention. For example, the game board and arrangement of holes can have other shapes, such as a circle or a triangle. This would lead to the construction of a three-dimensional cone or tetrahedron respectively, instead of a pyramid. Also, the three-dimensional structure can be composed of other numbers of pieces and levels, instead of the 55 pieces and 5 levels in the embodiment mentioned above.

Thus the scope of the invention should be determined by the appended claims and their legal equivalents, rather than by the examples given.

I claim:

1. A method of playing a mathematical game by a plurality of players comprising the steps of:

a) providing a game board;

b) providing at least two sets of playing pieces, each set comprising a plurality of playing pieces bearing numerical characters, said playing pieces having the ability to be placed onto said game board and onto a layer of said playing pieces which have been previously placed on said game board;

c) providing each player with one of said sets of playing pieces;

d) each player drawing an equal number of playing pieces from his/her set of playing pieces;

e) one of the players selecting a target number by operating a means for randomly determining a number;

f) each player competing to be the first player to find a mathematical expression equalling said target number using the numbers on his/her drawn playing pieces, the number on playing pieces previously played on the game board, and mathematical operations;

g) the first player to find said mathematical expression placing those of his/her drawn playing pieces used in the mathematical expression on the game board in a predetermined fashion, whereby a three-dimensional structure is constructed out of said playing pieces;

h) said first player drawing a number of replacement playing pieces from his/her set of playing pieces equal to the number of pieces placed;

i) repeating the steps of (e)–(h) until play ceases;

j) providing a point score for each player by awarding points for each of the playing pieces belonging to that player on the game board, using a predetermined method.

2. The method of playing a mathematical game of claim 1 wherein the step of providing a point score comprises awarding a greater number of points for playing pieces on higher layers of said three-dimensional structure.

* * * * *